US005309572A

United States Patent [19]

Seamans

[11] Patent Number: 5,309,572

[45] Date of Patent: May 10, 1994

[54] GARMENT SUPPORT APPARATUS

[76] Inventor: Phillip W. Seamans, 5216 Newton Ave. North, Minneapolis, Minn. 55430

[21] Appl. No.: 835,282

[22] Filed: Feb. 13, 1992

[51] Int. Cl.[5] ..... A41F 5/00; A41F 7/00

[52] U.S. Cl. ..... 2/112; 2/94; 2/107; 2/120; 2/336

[58] Field of Search ..... 2/94, 107, 108, 111, 2/112, 117, 120, 215, 216, 217, 223, 229, 230, 231, 232, 300, 332, 303, 304, 305, 306, 307, 308, 310, 311-322, 333-337, 340-342; 24/3 L, 3 D, 306, 698.1, 698.2; 224/252, 269, 208, 218

[56] References Cited

U.S. PATENT DOCUMENTS

| | | | |
|---|---|---|---|
| 301,484 | 7/1884 | DeGeorgia | 2/230 |
| 309,635 | 12/1884 | Maas . | |
| 388,123 | 8/1888 | Cohen . | |
| 399,238 | 3/1889 | Brodnax . | |
| 443,376 | 12/1890 | Peiter . | |
| 610,133 | 8/1898 | Graham | 24/698.2 |
| 820,856 | 5/1906 | Ettinger . | |
| 866,183 | 9/1907 | Bernstein . | |
| 957,117 | 5/1910 | Snow . | |
| 1,026,302 | 5/1912 | Cates . | |
| 1,107,303 | 8/1914 | Henderson . | |
| 1,110,822 | 9/1914 | Reznicek . | |
| 1,280,184 | 10/1918 | Dow . | |
| 1,326,887 | 12/1919 | Wood | 2/300 |
| 1,470,395 | 10/1923 | Smith | 2/318 |
| 1,550,720 | 8/1925 | Vidmer . | |
| 1,986,508 | 1/1935 | Leighton . | |
| 2,053,169 | 9/1936 | Stork . | |
| 2,059,826 | 11/1936 | Tartikoff . | |
| 2,308,278 | 1/1943 | Gluckmann . | |
| 2,315,698 | 4/1943 | Gluckmann . | |
| 2,437,714 | 3/1948 | Thomason, Jr. . | |
| 3,167,786 | 2/1965 | Johnson . | |
| 3,793,681 | 2/1974 | Casstevens, Jr. et al. | 24/698.2 X |
| 4,613,991 | 9/1986 | Grover | 2/23 |
| 5,032,104 | 7/1991 | Rainville | 2/101 |
| 5,040,524 | 8/1991 | Votel et al. . | |
| 5,086,516 | 2/1992 | Baxter et al. | 2/108 |
| 5,105,477 | 4/1992 | Golde | 2/93 |

FOREIGN PATENT DOCUMENTS

| | | | |
|---|---|---|---|
| 21436 | 9/1935 | Australia | 2/117 |
| 695293 | 8/1953 | United Kingdom | 2/117 |

*Primary Examiner*—Clifford D. Crowder
*Assistant Examiner*—Jeanette E. Chapman
*Attorney, Agent, or Firm*—Moore & Hansen

[57] ABSTRACT

An adjustable elastic system supports a body encircling band or the belt of a lower body garment from an upper body garment, using multiple straps removably and adjustably attached by means of loop material-hook material couples to the inside lining of the upper garment. The lower end of each elastic strap includes a hitch which is slipped under the belt by means of an integral tab.

24 Claims, 6 Drawing Sheets

GARMENT SUPPORT APPARATUS

BACKGROUND OF THE INVENTION

This invention relates to apparel worn by men and women. More particularly, this invention pertains to a system for supporting trousers and other lower body garments.

There is a wide range of human body shapes, resulting not only from genetic inheritance but also from differences in diet, illnesses, exercise, aging processes, accidental disfigurement, and other environmental factors. Clothing manufacturers make wearing apparel in standard combinations of dimensions and sizes, resulting in a lack of well-fitting clothing for a large contingent of the population having body proportions which do not conform to the proportions of the standard sizes.

Belts are commonly used by the general population for supporting trousers, pants, skirts and the like. The belt is tightened about the waist in a closed circle having a circumference smaller than the circumference of the hips below the belt. Suspenders are also used, either alone or in conjunction with a belt, to support the weight of the lower body garment from the wearer's shoulders. Some persons have a waist larger than the hips, making the use of belts impractical. Without additional support, the trousers or similar garment will tend to slip downward from the person's body, causing embarrassment and/or discomfort. Thus, mature men and women may find it difficult to wear jeans with dignity and comfort. For such persons, the use of conventional suspenders is less than satisfactory in several common situations. The length of the free suspenders makes them difficult to keep clean. For example, when the front attachments of the suspenders are unhooked from the lower body garment in order to use a urinal from a standing position, the free ends of the suspenders often slip backward over the person's shoulders. Having lost the support, the trousers and the long suspenders drop to the often unsanitary floor, becoming wet and soiled. Likewise, when using a toilet, the suspenders wearer often drops the suspenders onto the floor.

A person using suspenders to support trousers, and wearing a vest, jacket or other upper body garment over the suspenders, faces a further problem when using a toilet. The person must remove such garment or garments in order to rehitch the suspenders and trousers following toilet use.

Some persons have a body shape in which the hips are overexaggerated in size relative to the waist. While such persons may use suspenders and a "fuller" upper body garment to minimize the size difference, the above-named disadvantages remain.

For these and other reasons, persons with oversized or exaggerated proportions often resort to the almost exclusive use of coveralls with integral suspender straps.

The use of bullet-proof garments by police, security officers, the military and others is becoming more common. However, such garments are warmer than conventional clothing and restrict air circulation about the body, producing discomfort. The need exists for a system which enables the trousers to be suspended loosely while used with such security garments so as to increase the circulation of air for dissipation of heat and perspiration.

Persons such as military personnel who carry weapons or other heavy items suspended from the pants belt usually experience chafing of the pants against the hips and waist due to the excessive weight supported thereon. The need exists for a system to support the heavy items as well as the pants and belt from the person's shoulders, to increase freedom of movement, and permit air circulation in both the upper body and lower body garments. Such a system would find particular utility when conducting military operations in hot climates.

SUMMARY OF THE INVENTION

The invention is a system for supporting a body encircling band or belt from the shoulders of the wearer, through an upper body garment.

In one embodiment, the invention comprises a system for supporting a lower body garment from an upper body garment. The system preferably includes a generally non-stretchable panel or panels of which a portion has a face of attachment material such as loop fabric of a loop-and-hook couple collectively known and sold under the trademark Velcro. The attachment portion is preferably made of a loop fabric which is sewn or otherwise joined to the non-stretchable panel so that its loop surface faces the wearer's body. The attachment portion may overlie the panel or may be edgewise joined to it, for example. The upper body garment may be a shirt, blouse, vest, jacket, shirt-jacket or other garment which is supported by the wearer's shoulders. The face of attachment material is located for releasable attachment of a plurality of downwardly extending support straps in a range of vertically and horizontally adjustable positions. The panel or panels are configured to be supported by the shoulders of the wearer so that considerable weight may be comfortably supported on the attachment portions.

A belt or band is attached or attachable by e.g. conventional belt loops to the upper portion of a lower body garment for support thereof. The belt is preferably of semi-rigid construction and is supported by the support straps hanging downwardly from the upper body garment. Each of the support straps connecting a panel in the upper body garment with the belt or band of the lower body garment includes a portion having an attachment surface which compatibly adheres to the particular attachment material associated with the panel. For example, if the panel includes a surface of Velcro loop material, one end of each strap will include a surface of Velcro hook material. The loop material and hook material together comprise a couple which becomes joined when the facing surfaces are placed in contact.

In addition, the opposite end of each strap includes a lower hook or hitch which is detachably connectable to the band or belt, and means by which the wearer may readily and quickly connect and disconnect the hitch from the band or belt. The ends of the straps are connected by an elongate strip of fabric or other material. The connecting strip may include a strip of elastic material to permit the strap to stretch to a predetermined limited degree.

In a preferred embodiment, panels are provided in the reverse surfaces of each of the left and right quadrants of the front and rear of the upper body garment. Alternatively, the rear of the upper body garment may include a single panel, or a single panel may be provided which has portions thereof in the front quadrants as well as in the rear.

Likewise, the upper body garment includes at least one face of attachment material, and the front quadrants as well as the rear of the garment have areas of such material, so that straps may be attached thereto both in the front and rear.

In one embodiment, four straps are adjustably suspended from the panels and support the lower body garment belt in four places. The four-point suspension is effective in maintaining the lower body garment in a given position relative to the body in spite of changes in the stance of the user or activity by the user.

A three-point suspension may also be used, wherein a support strap is used in the left front and right front quadrants of the upper body garment, and a single strap is used in the rear of the garment.

Corresponding panels on the front and rear of the upper garment may be joined to form a single generally non-stretchable member which passes over a shoulder or the shoulders and is joined to the upper body garment to be integral therewith. These members place the weight onto the shoulders; these members may be flared in the area of the shoulders to distribute the supported weight more uniformly on the user's shoulders.

The particular support position of the strap on the attachment material on the panel is quickly and easily adjusted by the user, merely requiring an inward pull on the strap to separate it from the attachment face in the upper body garment. The strap may then be repositioned on the face at the desired position, and pressed into the face to reattach it thereto.

Use of the system provides a streamlined profile to the wearer by equal suspension from the shoulders rather than the wearers waist. In addition, the lower body garments are fully supported in a more loosely-fitting, draping configuration, resulting in enhanced comfort and security. The tendency for the lower body garment to inadvertently fall from the body is overcome.

In one embodiment, the apparatus is particularly adaptable to popular street clothes such as jeans and jean jackets and/or jean-vests.

In another embodiment, the system is useful for supporting adult diapers worn by persons subject to incontinence of evacuative functions. If desired, a simple locking mechanism may be utilized to prevent a patient from removing the diaper without assistance from a nurse or other attendant.

In further embodiments, the system may be advantageously incorporated into various military wear to enhance the support of arms, ammunition and other heavy objects suspended on the trousers belt. The system is also useful in conjunction with bullet proof wear such as specially configured leisure suits, sweaters and the like worn by security personnel.

The system may be integrated into clothing, including formal and semiformal wear, to be essentially invisible to others.

Other embodiments, uses, and advantages thereof will become evident in the following detailed description of the preferred embodiments by reference to the attached drawings.

DETAILED DESCRIPTION OF THE ILLUSTRATED EMBODIMENTS

Figure 1:
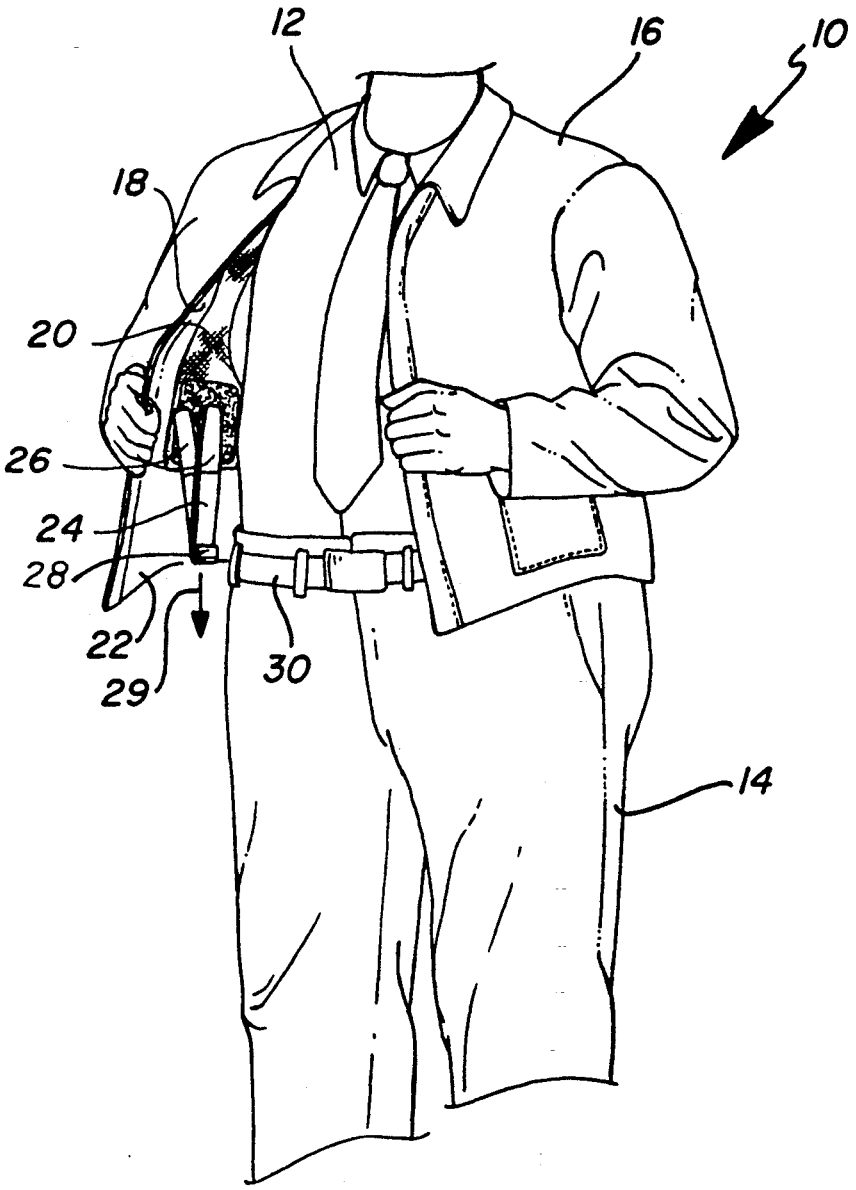
FIG. 1 is a perspective general frontal view of the lower body garment support system as applied to a jeans and jean-vest set of apparel.

Referring now to FIG. 1, a person 10 is shown wearing a shirt 12, a lower body garment 14 shown as a pair of jeans and an upper body garment 16 shown as a jeans-vest. One side of the jeans-vest 16 is shown being held open to reveal a portion 20 of loop fabric attachment material attached by sewing, cementation or other means to the reverse surface 22 of the vest 16. A support strap 24 has a hook material end 26 which faces, and is in engagement with the loop fabric portion 20. A hitch 28 at the opposite end of the strap 24 comprises a belt-hook which may be attached to a band or belt 30 in jeans 14 to support the jeans. The combination of loop fabric and hook material comprises an attachment couple exemplified by materials sold under the trademark Velcro. Such attachment materials can carry heavy loads in a direction parallel to the attachment surfaces or faces, and are easily detached by hand forces in a direction normal to the attachment surfaces. Other types of attachment couples may also be used in the invention.

The front of the vest 16 may be normally closed by buttons or a zipper, for example, to completely hide the support system from view. When the belt hooks 28 are attached to the band or belt 30 on the left and right sides of the wearer's front, the straps 24 pull the front portions of the upper body garment 16 against the wearer's body, tending to hold the upper body garment 16 closed. The lower body garment is supported by belt 30 which in turn is suspended by the straps 24 from the wearer's shoulders acting through vest 16. While the preferred upper body garment has an openable front, a closed garment such as a typical sweater may also be utilized.

The lower body garment support system 32 includes the attachment loop fabric portion 20 and the support strap 24 with its first attachment end(s) 26 and hitch 28.

While FIG. 1 depicts the lower body garment 14 as a pair of conventional long trousers, the support system of the invention is useful for suspending shorts and skirts as well as bands or belts on which heavy items such as tools or weapons are carried. For the latter uses, the band or belt may be worn separately from the conventional trousers belt. The system may also be used to support both the trousers and a separate band or belt by using a plurality of separate supporting straps for each.

Figure 2:
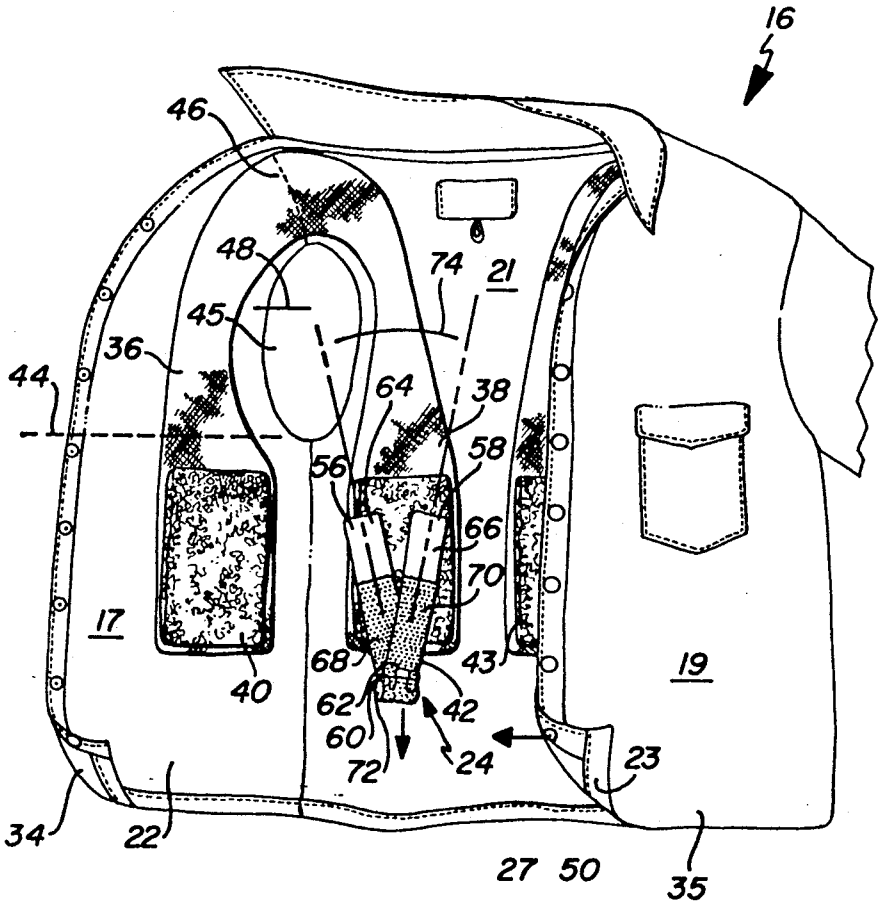
FIG. 2 is a front view of an upper body garment incorporating a support system in accordance with the invention.

The invention is shown more completely and in greater detail in FIG. 2 as installed in an upper body garment 16 comprising a shirt-jacket. The garment 16 is opened to show the right half of the support system. The garment 16 has a right front quadrant 17 with an obverse surface 34 and a reverse surface 22, and a left front quadrant 19 with an obverse surface 35 and a reverse surface 23. The garment back 21 has an obverse surface, not shown and a reverse surface 25. In this description, the term "obverse" denotes a direction outward from the wearer's body, and the term "reverse" indicates a direction toward the wearer's body. The band supporting apparatus in the left side of the upper body garment is preferably a mirror image of the apparatus in the right side of the garment. Thus, a left-side rear attachment panel 39 is shown with a loop attachment surface 43.

A front reinforcement 36 and a rear reinforcement panel 38 are shown sewn or otherwise affixed to the reverse surfaces 22, 25, i.e. the inside surface or lining 27 of the shirt-jacket 16. Panels 36 and 38 are shown as including loop attachment fabric surfaces 40, 42 respectively, which overlie reinforcement panels 36 and 38. The two reinforcement panels 36 and 38 are formed from a strong, generally non-stretching material and extend upwardly, preferably higher than the bottom 44 of the arm opening 45 to ensure adequate support for the lower body garment band or belt (not shown).

In FIG. 2, the reinforcement panels 36, 38 are shown as extending upwardly to meet and join in a flared portion 46 at the top of the shoulder (FIG. 1). In this configuration, the panels 36, 38 provide distributed shoulder support to the loop surfaces 40, 42 of the panels 36, 38. The reinforcement panels comprise a non-stretch or low-stretch fabric such as denim or the like. Such a fabric is one which will not stretch relative to the upper body garment 16 when placed under the normal anticipated loading. Preferably, the panel fabric stretches much less than the garment fabric, so that the application of heavy loads to the system does not stress the garment fabric. Understandably, the strength of the panel fabric must be sufficient to effectively support the particular static and kinetic loads applied thereto.

The attachment portions, i.e. loop surfaces 40, 42 are shown as formed of reinforcement material which is overlain by loop material, e.g. fabric which has a loop surface facing in the reverse direction, i.e. toward the wearer's body. Alternatively, the attachment panels may simply comprise loop panel portions attached or connected directly to the reverse surfaces 22, 23, 25, i.e. lining 27 of upper body garment 16.

The hook material placed on straps 24 to face the loop surfaces 40, 42 comprises a planar base or pad from which a large number of small hooks project. When placed in contact with a material to which the hooks become attached, such as a loop fabric, the loop fabric and hook material are tenaciously held together, particularly when the separating forces are in a direction coplanar with the attachment coupling surfaces. Nevertheless, the two materials may be separated by pulling the two apart at an angle approximately normal to the attached surfaces of loop fabric and hook material. In one form, the combination or couple of loop and hook materials is sold under the trademark Velcro.

The use of hook material in the faces of attachment surfaces 40, 42 is generally unsatisfactory because hook material in the panels can interact with the fabric of the garment (e.g. shirt or sweater) worn under the upper body garment 16, and will become attached thereto. This is especially true of fabrics often found in sweaters and sweatshirts, and some shirt fabrics. Thus, the attachment surfaces 40, 42, are preferably constructed of loop material rather than hook material. The loop material will not become attached to itself or to other non-hook type materials.

As depicted in FIG. 2, the complete support system may use a panel 36 or 38 and a reverse facing loop surface 40 or 42 mounted in each of the four quadrants of the upper body garment 16. Each loop surface 40 or 42 is thus associated with a single support strap 24 having an obverse facing 48 hook surface. The figure fully illustrates the suspension apparatus of only the right front quadrant and right rear quadrant of the garment 16. The suspension apparatus in the other quadrants is typically a mirror image of that illustrated.

The support strap 24 is shown in FIG. 2 as having two arms 56 and 58 joined at seam 60 near hitch 62. Each arm includes an essentially non-stretchable terminal portion 64, 66 having a hook attachment surface on the obverse side, shown as facing and pressably attached to the loop surface 42. The terminal portions 64 and 66 are joined to hitch 62 by strips 68 and 70, respectively, the latter extending to seam 60 where they are joined. Strips 68 and 70 may be formed of an elastic or non-elastic material, or a combination thereof. The strip material has sufficient strength and non-elasticity to support the applied load without normally stretching. Use of an elastic material enhances the ease with which the wearer may hitch and unhitch the support apparatus from a lower garment belt. Hitch 62 is attached to the elastic strips 68, 70. Also shown is a finger manipulable loop 72 adjacent the hitch 62 for pulling the strap 24 downwards and hitching the hitch 62 to a band or belt, not shown, which may be attached to a lower body garment.

As shown in FIG. 2, the hook surfaces of terminal portions 64 and 66 may be variably joined to the loop surface 42 over a range of vertical and lateral positions depending upon the size of the loop surface 42. The loop surface size is configured to provide the range of positions needed to support a wide variety of lower body garments. In addition, the angle 74 between the two arms 56, 58 may be varied to change the resistance to lateral movement of the hitch on the belt or band. As the angle 74 is increased, the horizontal component of the supporting force increases, resulting in an increased resistance to lateral movement of the hitch on the belt.

Figure 3:
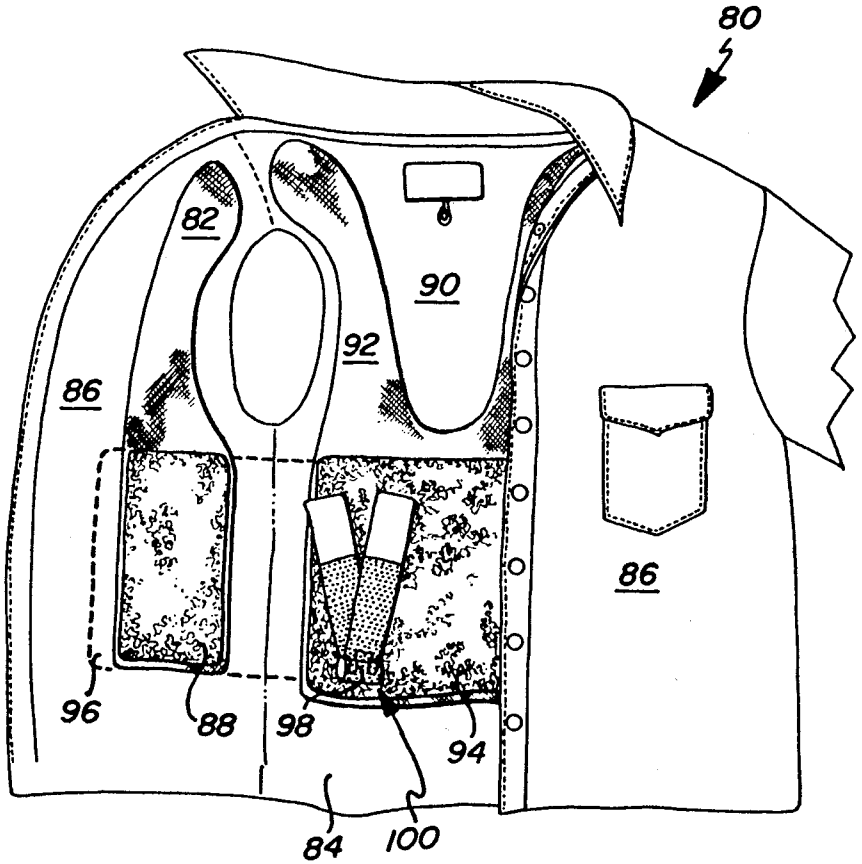
FIG. 3 is a front view of a further embodiment of an upper body garment incorporating a support system of the invention.

FIG. 3 illustrates other modifications in the invention. An upper body garment 80 has a reinforcement panel 82 mounted in the reverse side 84, of each of the front quadrants 86, 88. Each panel 82 includes a portion of reverse facing loop surface 89. The back 90 of the garment is shown with a single reinforcement panel 92 having a reverse facing loop surface 94. Preferably, the loop surface 94 overcovers the middle portion of the back 90 so that a single strap 100 may be used therewith for relatively light loads. Of course, with heavy loads, two or three straps may be used if necessary. The dimensions of the loop surface are such that the desired supportive positioning of the hook 98 is achieved. If desired, a single body encircling loop surface 96 may be used (dotted lines) for detachable attachment of the front and rear straps 100.

In the embodiment shown in FIG. 3, the reinforcement attachment panels are not connected over the shoulder. More specifically, front attachment panel 82 is not connected to rear reinforcement attachment panel 92. Where the upper body garment 80 is constructed of a high strength material of low elasticity, such as heavy leather, use of reinforcement panels 82, 92 may be unnecessary. In this case, the loop faced articles 89, 94 may be sewn or cemented directly to the reverse surface 84, i.e. lining of the garment.

Figure 6:
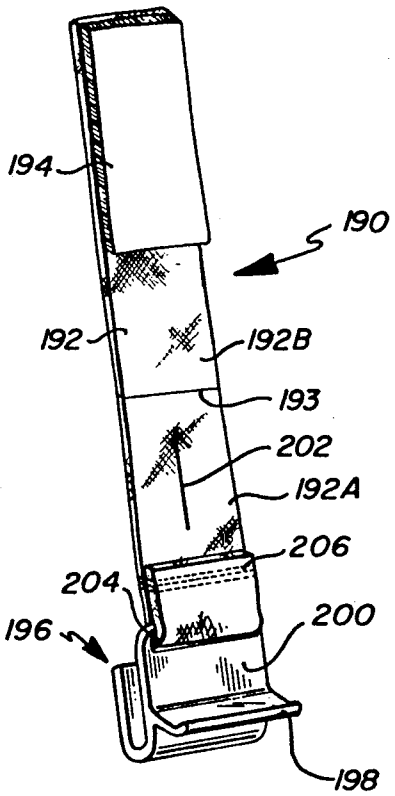
FIG. 6 is a front view of a further embodiment of the support strap and hitch of the invention.
Figure 5:
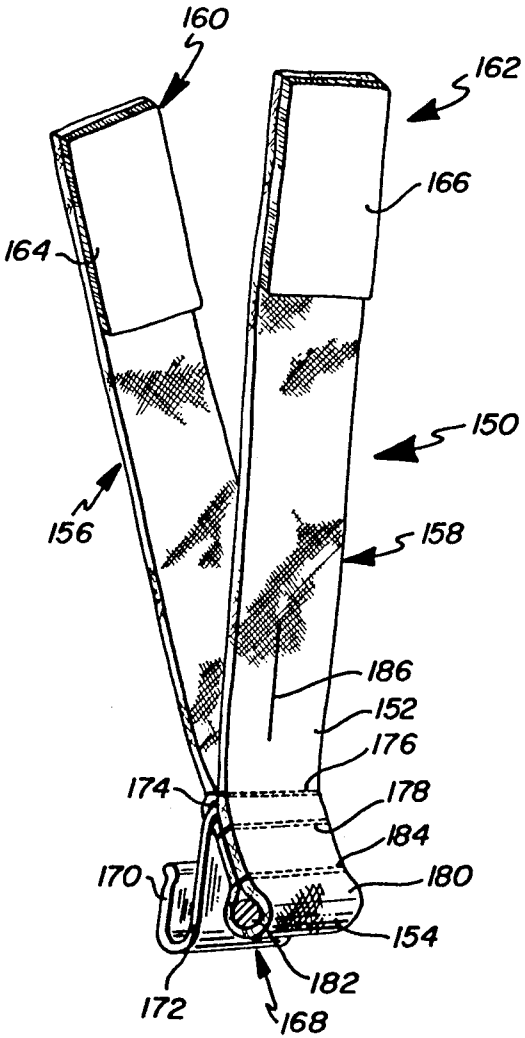
FIG. 5 is a front view of another support strap and hitch of the invention.
Figure 4:
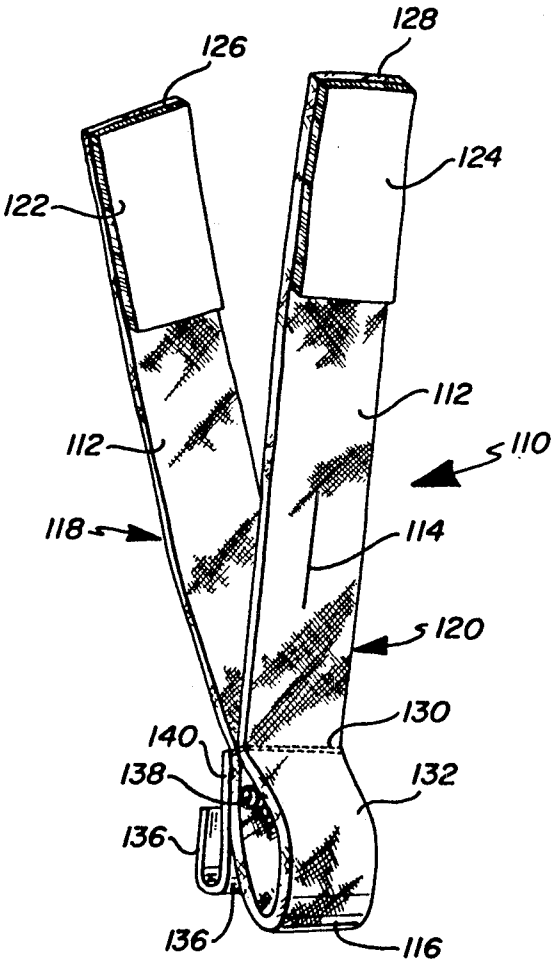
FIG. 4 is a front view of a support strap and hitch of the invention.

The drawings of FIGS. 4–6 illustrate several embodiments of strap construction, as viewed from the obverse side. As shown in these figures, the support strap is a detachable and adjustable member which supports the band or belt girdling the waist section of a person. The band or belt may be configured to support a lower body garment, tools, weapons or other items. As shown in FIG. 4, a support strap 110 includes a strip 112 of material which has a desired degree of elasticity depending on the downward forces generated by the item to be supported. The strip 112 may be formed of, or include elastic material to obtain the desired elongation in direction 114 under stretching forces. The strip 112 is transversely folded in its central portion 116 so that the two resulting arms 118, 120 overlap. Pads 122 and 124 of hook material are attached by cementation, sewing, rivets, or other attachment means to ends 126 and 128, respectively, of the strap 110. The pads 122, 124 are attached so that the hook material of both pads faces the obverse direction, i.e. toward the lining of the upper body garment and away from the user's body. A transverse sewn seam 130 is shown as resulting in a tab or loop 132 in the central portion 116 of the strip 112. If desired, the tab or loop 132 may include a non-stretchable material, not shown, combined with the stretchable elastic strip 112, or separately attached to the elastic strip. A hitch 134 is shown with its front 136 attached to the tab or loop 132 by rivets 138 so that the rear 140 of the hitch faces a reverse direction, i.e. opposite to that of the pads 122, 124. The tab or loop 132 is configured to be manipulated by a wearer's fingers to draw the hitch downward for attachment e.g. under a belt in the wearer's trousers or other lower body garment.

The support strap 150 shown in FIG. 5 is similar to that of strap 110 of FIG. 4. An elastic strip 152 is folded in the central portion 154 to form two arms 156, 158, each having a first end 160, 162 respectively with an attached pad 164, 166 of obversely facing hook material. Hitch 168 is shown as a hook with a rear, i.e. reverse facing side 170 and front, i.e. obverse facing side 172 which clasp and support a belt or band therebetween. The hitch 168 is shown with a slot 174 in its front side 172. The elastic strip 152 passes through the slot 174, and the two arms 156 and 158 are transversely sewn together at seams 176 and 178 on both sides of the slot 174, thereby mounting the hitch 168 in a given position. FIG. 5 shows the central portion 154 of the strip 152 formed into a finger manipulable tab 180 of elastic material. The tab 180 includes a short rod 182 retained between the elastic material by sewn seam 184. The increased thickness at the end of the tab 180 facilitates grasping of the tab between the thumb and a finger for drawing the hitch 168 downward in direction 186 for attaching the hitch rear 170 under a belt or band.

The strap having two arms is especially useful for preventing significant lateral slippage of the hitch on the belt. The latch position may be made more secure by attaching the two arms to the loop material in a position with the first ends 160, 162 widely separated.

A modified version of the support strap is depicted in FIG. 6. Support strap 190 has a single arm comprising an elastic strip 192, a pad 194 of hook material attached to one end of the strip 192, a hitch 196 at the opposite end of the strip, and finger manipulable means shown here as a lip 198 on the front side 200 of hitch 196. Lip 198 is configured for manually drawing the hitch 196 downward in direction 202 for hooking the hitch under a belt, and for unhooking the hitch. The hitch 196 is attached to the elastic strip 192 by passage of the strip through an opening 204 in the hitch and sewing along seam 196. This embodiment of the support strap supports a belt less rigidly than those shown in FIGS. 4 and 5.

Each of the support straps of FIGS. 4–6 may be adapted to be completely hidden from public view by the upper body garment from which the straps are suspended.

The hitch may take a variety of forms, depending upon the material of construction, the load, and the particular preferences of the wearer. Several exemplary embodiments are shown in FIGS. 7 through 12.

Figure 7:
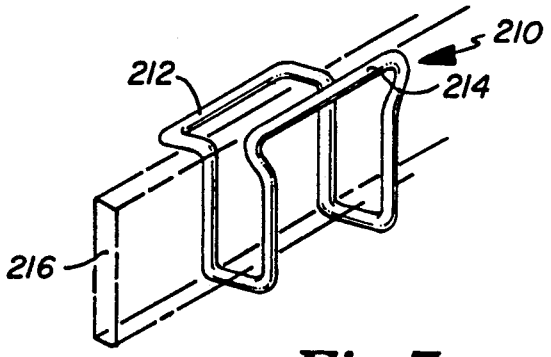
FIG. 7 is a rear perspective view of a hitch of the invention.

The hitch or hook 210 of FIG. 7 is formed of high strength rigid wire of a thickness which will support the requisite loads. A front member 212 is attached to the elastic strip, not shown, and a rear member 214 is configured to pass under a belt 216, shown in phantom.

Figure 8:
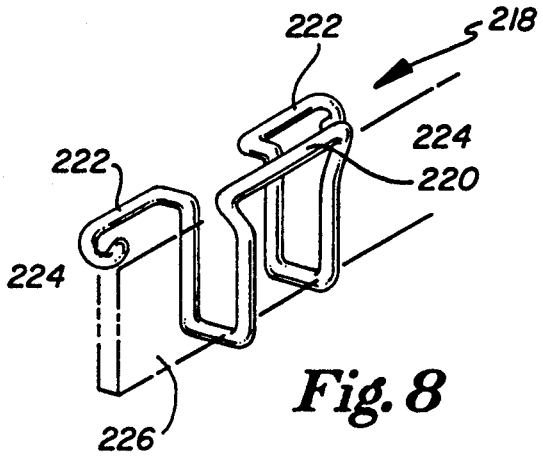
FIG. 8 is a rear perspective view of another hitch of the invention.

The hitch or hook 218 of FIG. 8 is also formed of rigid wire, and has a rear member 220 and a front member 222 having outwardly projecting ends 224. The elastic strip, not shown, is attached to the front member 222, and recurved ends 224 project laterally from the strip for use as finger manipulable tabs to draw the hook downward for hitching rear member 220 under a belt 226, shown in phantom.

Figure 9:
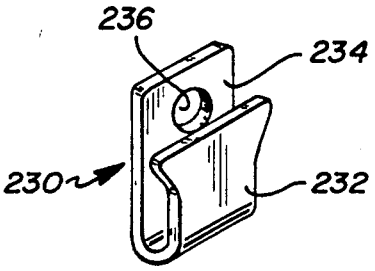
FIG. 9 is a rear perspective view of a further hitch of the invention.

In FIG. 9, a hitch 230 is formed of metal plate, molded metal or plastic, and has a rear side 232 and a front side 234. The front side 234 is shown with a hole or holes 236 for attachment to the elastic strip, not shown, with a rivet(s) or stud(s).

Figure 10:
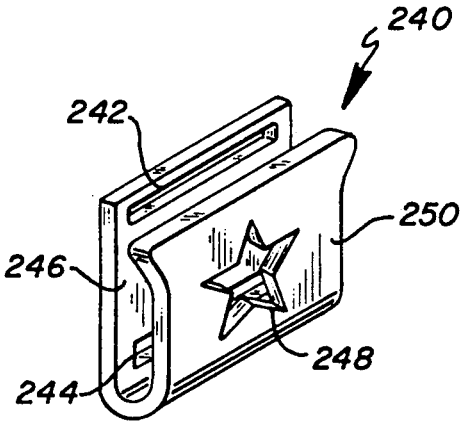
FIG. 10 is a rear perspective view of a yet further hitch of the invention.

The hitch 240 shown in FIG. 10 is similar to the hitch 230 of FIG. 9, but includes two slots 242, 244 in the front side 246. The hitch 240 is also shown with a cutout 248 in the rear side 250 to reduce its weight. The elastic strip, not shown, is passed through slots 242, 244 and fixedly connected to support the band or belt, not shown, between the front side 246 and rear side 250.

Figure 11:
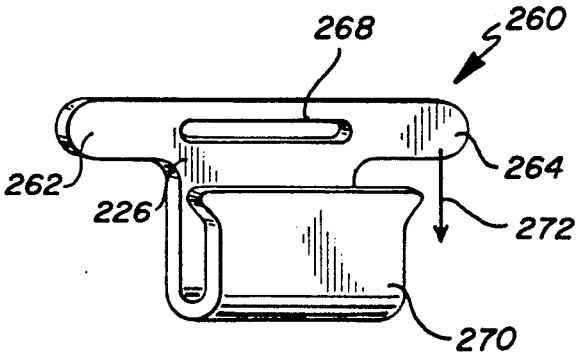
FIG. 11 is a rear perspective view of another hitch of the invention.

FIG. 11 depicts a hitch 260 similar to that shown in FIGS. 9 and 10, but having finger manipulable tabs 262, 264 extending laterally from the front side 266. A strip of a suspension strap, not shown, is mounted in slot 268 in the front side 266 for supporting the hitch 260 and the band or belt mounted therein. These tabs 262, 264 enable the hitch 260 to be drawn downward by the user in direction 272 to hitch the rear side 270 under the user's belt.

Figure 12:
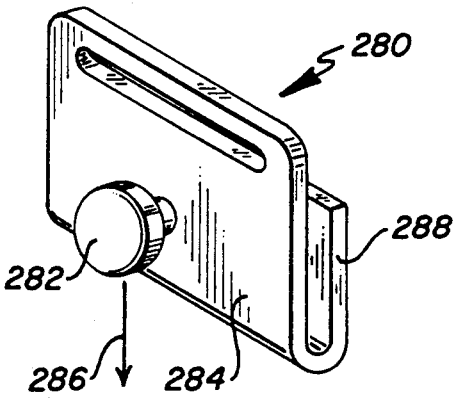
FIG. 12 is a front perspective view of a still further hitch of the invention.

In FIG. 12, a hitch 280 is shown as a hook with a handle 282 projecting from the front side 284 for manual manipulation of the hitch for attachment to a belt. Handle 282 may take any form of projection which is readily drawn downward in direction 286 by a user against the resistance of the elastic strip. The rear side 288 is configured to be drawn under a band or belt, not shown, for support thereof.

Other embodiments of the strap, and the hitch attached thereto, may be envisioned. Various features shown in the figures may be combined. In all of the figures, the rear of the hitch, when worn by a person, faces the wearer, i.e. the reverse direction. The front side of the hitch faces outwardly, i.e. obversely, and the tab or other manipulable means is on adjacent the front side for ready access and manipulation.

While the invention can be adapted to work with any type of band or belt, the belt should be of sufficient rigidity and strength to support the particular applied load without excessive bending, whether the load is a lower body garment, tools, armament, or other applied loads. Thus, a useful belt may be formed e.g. of thick rigid leather, or of semi-rigid plastic, or reinforced to increase its strength and rigidity. In one form, the hitch is formed of resilient material such as spring metal wherein the front and rear sides of the hitch compress the belt when installed thereon. Thus, the hitch may be disconnected from the belt by exerting a nominal downward force on the tab, pulling the hitch from the belt.

Each of the hitch embodiments has been described as having a front side which is normally on the outside or normally visible side of the belt, and a rear side which is hooked under the belt and remains between the belt and the wearer's body. In some instances, it may be desirable to have the hitch attached to the belt by inserting it downward between the belt and the lower body garment, drawing it upward so that the hitch rear is actually in front of the belt. In this configuration, the normal attachment of hitch to elastic strip must be reversed. This embodiment results in a hitch-to-belt engagement which is more difficult to unhitch.

While the attachment coupling surfaces are identified as the well-known hook and loop fabrics, any surface pair which will detachably join in a strong coplanar union may be used.

In operation, the system is first applied (see FIG. 1) by attaching the straps 24 to the front and rear attachment surfaces 20 in the reverse side 22 of the upper body garment 16. This may be done either before or after the upper body garment 16 has been put on. With the upper garment 16 on the wearer 10, the body encircling band or belt 30 is placed on the wearer, and each hitch 28 is drawn downwardly (see FIG. 1) in direction 29 until the rear side of the hitch 28 may be placed under the belt 30. The belt 30 is then fully supported by the straps 24. If necessary, the placement of each strap 24 may be then adjusted on the attachment surfaces 20 for maximum comfort.

As described above, the system is useful in a wide variety of applications, including normal street wear. Thus, the system is adjustable for any type of build, and compensates for non-typical body proportions. It is especially effective for supporting trousers and the like on persons having exaggerated hip and/or waist dimensions. The invention results in the belt or band support being independent of hip and/or waist sizes, having placed its support instead on the upper garment. The suspension system may be used to visibly present more balanced proportions in the body shape. The system enables the mature man or woman to wear jeans as well as leisure suits and formal wear with dignity and comfort. The ease with which the system is installed and operated makes it especially advantageous to the elderly and others who have lost muscle coordination or movement capability.

The system results in enhanced comfort to the user. The belt is not required to be tightly drawn about the waist but may be adjusted to a diameter much larger than the waist diameter. The loose belt increases air circulation and evaporation of perspiration, and reduces chafing, extremely important considerations in regions having a hot climate. When used to support a weighted belt, the full weight is suspended from the shoulders rather than from the hips, greatly increasing the carrying capacity as well as comfort. The mobility and comfort are particularly enhanced for persons involved in the construction trades and military personnel, where weighty loads are frequently carried on the belt and in or on the trousers. For example, a soldier will commonly carry small arms, ammunition, and a variety of other gear suspended on the trousers belt and in pockets, as well as on a separate belt. This invention permits such objects to be suspended from the upper garment with the load applied to the wearer's shoulders, while the trousers belt is but loosely applied. If desired, both the trousers belt and a separate belt may be simultaneously supported from an upper body garment, using a plurality of straps for each. The supported position of each is independently adjustable over wide vertical and horizontal ranges by the easy positioning of each strap on the attachment surface of the upper body garment.

Clothing which is constructed to be "bulletproof" not only restricts air circulation but also has a major drawback of being hot when worn. For example, a "bulletproof" garment may result in extreme discomfort due to retained heat and perspiration. Suspending the lower body garment from the upper body garment as described herein permits the garments to be separated from skin surfaces and allow increased air circulation adjacent the skin of the waist area.

The use of conventional suspenders is often uncomfortable because it is necessary to maintain considerable upward suspender force to ensure that the lower body garment is consistently supported, i.e. does not slip to any degree. The long length of elastic in conventional suspenders ensures that the garment will slip or fall a considerable distance for small increments of additional downward pressure on the garment. The support system of this invention limits downward slippage distance by using an abbreviated elastic strap (or even a strap without an elastic member) rather than long suspenders, thus limiting the available movement distance. If desired, further limitation on available slippage may be accomplished by forming the strip of elastic portions having different moduli of elasticity, e.g. a high modulus portion and a low modulus portion. The length of each portion is configured to provide the desired stretching characteristics. Thus, returning to FIG. 6, elastic strip 192 is shown as comprising a high modulus strip 192A and a low modulus strip 192B which are joined along seam 193 to form strip 192. Low modulus strip 192B stretches further upon application of a given stretching force than does high modulus strip 192A. The high modulus strip may be formed of a material with virtually no elongation under the applied loads. The dual modulus strip may be used in any of the strap configurations shown herein, depending upon the suspended load and the degree of the wearer's required movement.

Where very little elasticity is required, the strip may be formed of non-stretching fabric or a plastic or metal material, for example.

Figure 13:
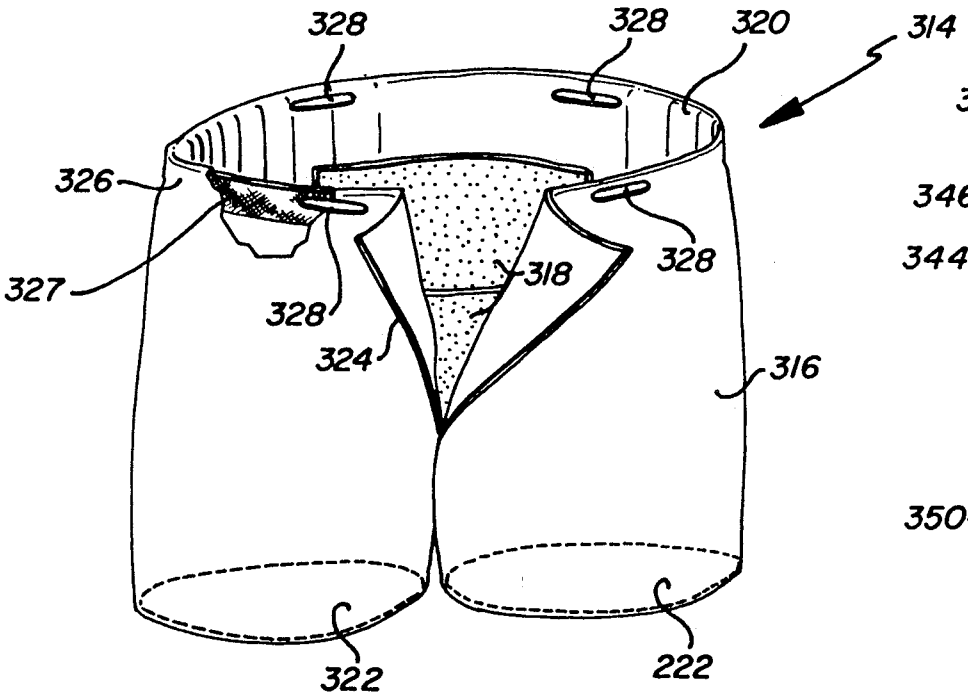
FIG. 13 is a front perspective view of an adult diaper adapted for use with the lower body garment support system of the invention.

The suspension system may also be applied to the support of an incontinence absorbent garment, commonly denoted as an adult diaper. Such diapers tend to slip downward, particularly when worn by persons of mature build, obese persons or those having large waists relative to the hips. As depicted in FIG. 13, an incontinence absorbent garment or diaper 314 has an outer waterproof cover or shell 316 lined with a pad of absorbent material 318. The absorbent lining may be fixed to the outer shell 316 but preferably is a separate disposable pad within the reusable cover 316. The shell 316 is formed of flexible plastic or rubber material. The diaper 314 has a body opening 320 and openings 322 for passage of the wearer's legs therethrough. A front or side fly 324 facilitates installation and removal from a wearer, and is secured by detachable tape or other means, not shown. For plastic shells or covers, the upper portion 326 of the diaper 314 which normally fits over the wearer's hips may include an elastic member, not shown, which draws the diaper closely about the wearer's body. The diaper 314 includes openings 328 spaced about the upper portion 326 for attachment of previously described suspension hitches (FIGS. 7–12) therethrough. A band or belt 327 is shown integrally formed in the shell 316 so that openings 328 pass therethrough. The band 327 provides strength to the diaper for support from an upper body garment.

Figure 14:
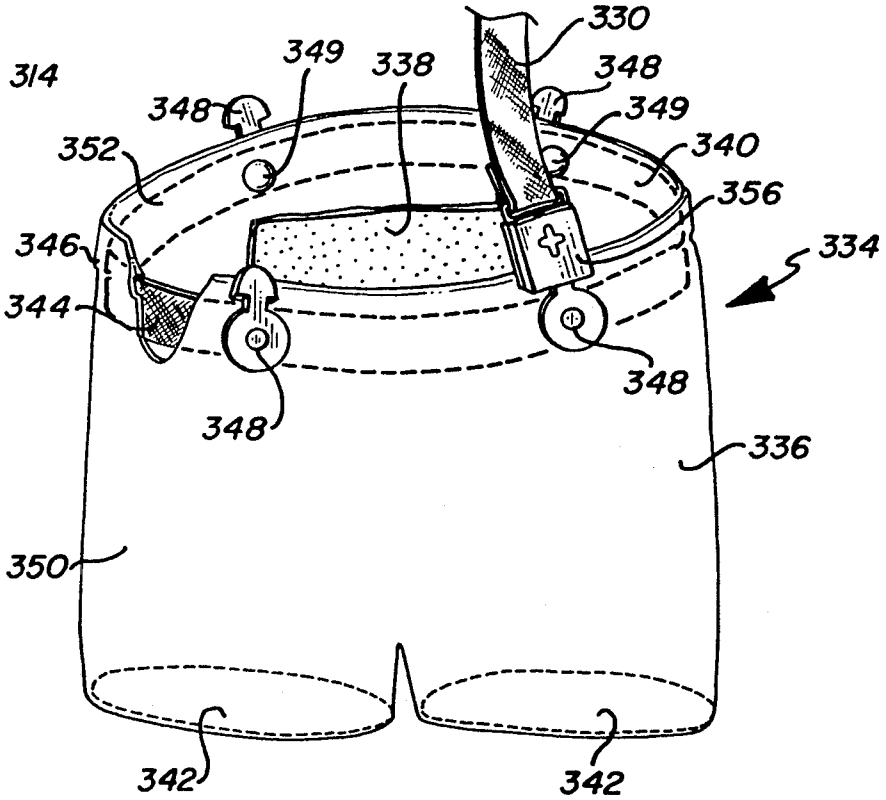
FIG. 14 is a front perspective view of a further embodiment of an adult diaper supportable by the support system of the invention.

A further embodiment 334 of a supportable diaper is shown in FIG. 14. This version provides means for locking the diaper to supporting straps, and is particularly useful for maintaining the integrity of the diaper when the wearer by mental aberration is disposed to remove it. The diaper 334 includes a waterproof cover 336 such as plastic or rubber, with an interior lining pad 338 of absorbent material. The diaper has a body opening 340 and leg openings 342. The cover 336 and lining pad 338 are configured to enable the diaper 334 to expand somewhat in size to be easily fitted on a user. An elastic band or belt 344 is shown encircling the upper part 346 of the diaper 334. The band 344 may comprise a thickened portion of the shell 336 and thus not be a separate item. In any case, the system may be fabricated to have sufficient strength for withstanding efforts by the wearer to forcibly remove the cover, or separate the straps 330 therefrom. The figure also shows upwardly directed couplings 348 installed in the left and right sides of the front 350 and rear 352 of the diaper 334. The coupling 348 is configured to fit into a lockable buckle 356 which is attached to a suspension strap 330 such as depicted in FIGS. 1–6. The buckle 356 acts as a locking hitch which prevents or deters removal of the incontinence garment without the assistance of a nurse or other institutional employee. The couplings 348 are shown as being riveted or otherwise joined to the cover 336 by backing members 349 on the inside of the diaper.

The straps 330 are removably attached to an upper body garment which preferably has a closed front, i.e. it is installed on the wearer by passage over the head. Such a system may be readily installed by another person, yet is more difficult to remove by the typical infirm patient-user.

Figure 15:
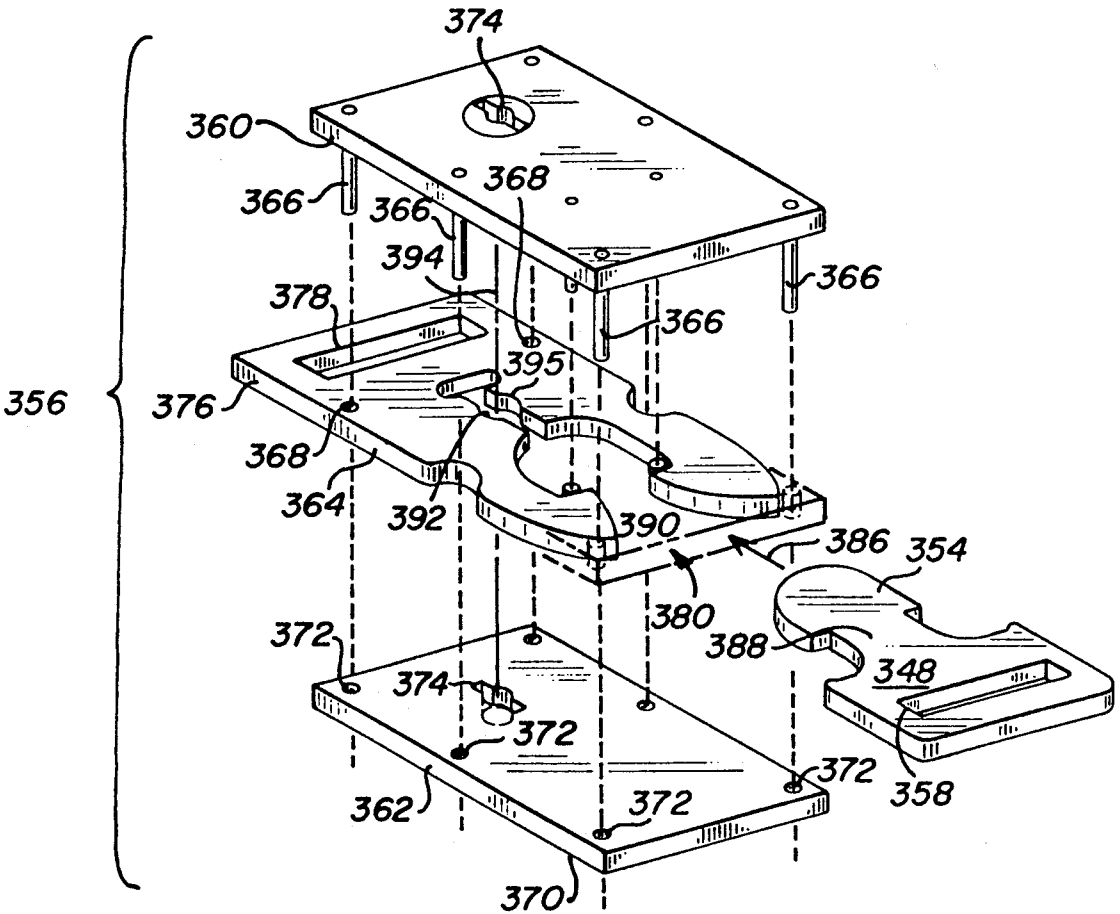
FIG. 15 is an exploded perspective view of a lockable latch useful with the diaper support system.

Turning now to FIG. 15, an exemplary coupling-/buckle pair is shown in exploded view. The coupling or dog 348 is shown as a planar member with an expanded head 354 at one end for detachable joining to the buckle 356. Means for attaching the coupling 348 to the diaper is shown here as a slot 358, but may comprise an aperture for rivets, a surface to be cemented, or other attachment means. Buckle 356 is shown as formed of front and rear planar members 360 and 362, and a lock mechanism 364 therebetween. The three components are shown as being joined by peripheral posts 366 extending from the front member 360, through apertures 368 in or past the central lock 364, passing through apertures 372 in the rear member 362 and joined to the rear planar member 362, as by welding on the exterior side 370 or other joining method. The components may be formed of plastic, metal, or similar materials. The central lock mechanism 364 is shown as being longer in one dimension; the elongated end portion 376 includes a slot 378 through which a support strap as previously described may be attached. Optionally, the rear member 362 and/or front member 360 may also include an elongated portion with means for attachment to a strap.

Figure 16:
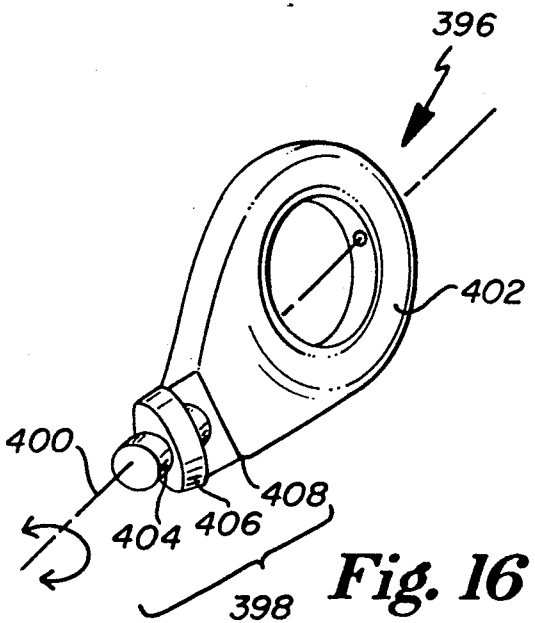
FIG. 16 is a perspective view of an exemplary key for unlocking the latch of FIG. 15 in accordance with the invention.

The lock mechanism 364 is clamped between the front and rear buckle members 360, 362. It comprises a generally planar member with an opening 380 between opposed latch arms 382, 384. The length of the opening 380 and elasticity of the latch arms 382, 384 permit the arms to be bent outwardly as the coupling head 354 is inserted therebetween in direction 386. The coupling head 354 is inserted until the narrowed neck 388 of the coupling 348 passes the opposed cogs 390. At that point, the latch arms 382, 384 spring inwardly to hold the coupling head 354 in a locked position. As shown in FIG. 14, the opening 380 in the locking mechanism 364 is extended toward elongated portion 376 as a slot 392. The slot 392 is configured at key insertion axis 394 as a keyhole portion 395 so that a key may be inserted into the slot 392 and rotated to expand the opposing arms 382, 384 to a distance at which the coupling 348 may be extracted from the buckle 356. Each of the front and rear members 360 and 362 of the buckle 356 is shown with a keyhole 395 therethrough for insertion of a key (FIG. 16) to unlock the lock mechanism 364 and release the coupling 348 therefrom. As shown in FIG. 16, the key 396 may be configured to have an insertable end 398 which is rotated about a central axis 400 by a key handle 402. The insertable end 398 is shown having a lower shaft portion 404, a cam portion 406 and an upper shaft portion 408. When fully inserted in the keyhole 395, the lower shaft portion 404 is within the rear member 362, the cam portion 406 is within the central lock mechanism 364, and the upper shaft portion 408 is within the front member 360. Upon rotation of the key handle 402, the cam portion 406 expands the key hole portion 395 of slot 392, separating the latch arms 382, 384 and releasing the head 354 of coupling 348.

Lockable diapers are useful for the care of infirm patients who have sufficient strength to pull off the presently available commercial diapers, whether deliberately or inadvertently, but insufficient strength or intelligence to separate the hook material of the straps from the loop fabric panels. Installation of the loop fabric panels high on the lining of the upper garment, yet below shoulder level, makes accessibility and self-removal more difficult.

Reference herein to specific details of the illustrated embodiments is not intended to restrict the scope of the appended claims which themselves recite those features which are regarded as important to the invention.

What is claimed is:

1. A system for suspending a body encircling band from an upper body garment, said upper body garment and band being wearable on the body of a person, said system comprising:

an upper body garment having an inside surface and a shoulder portion and wearable on the body of a person;

at least one non-stretchable panel attached to said inside surface of said upper body garment for support by said shoulder portion, a portion of each said panel covered at least in part with a first coupling material surface comprising a loop surface; and a plurality of support straps, each strap comprising:

an elongate strip of elastic material having first and second ends and folded in the center thereof between said ends;

a hitch affixed to said elastic material between said first and second ends thereof; and pads of hook material joined to said first and second ends and comprising a second coupling material surface, said pads configured to face said inner surface of said upper body garment for detachable adjustable attachment to said loop surface.

2. The system of claim 1, wherein said first coupling material surface comprises a loop surface facing the person's body, and said second coupling material surface comprises a hook material surface wherein the area of said loop surface is greater than the area of the hook material surface to permit variable vertical positioning and attachment of said hook surface to said loop surface.

3. The system of claim 1, wherein the vertical and lateral dimensions of said loop surface are larger than said hook surface to permit variable vertical and lateral positioning and attachment of said hook surface to said loop surface.

4. The system of claim 1, wherein said system includes one of three and four said straps, each said strap configured for detachable attachment to said band.

5. The system of claim 1, wherein each said hitch includes a hook having an upper end attached to said strap and a lower end configured to be removably fitted under the edge of the band for support thereof.

6. The system of claim 1, wherein said hitch includes front and rear elements and is configured to clasp said belt between front and rear elements.

7. The system of claim 1, wherein said hitch comprises a wire bent to form a resilient hook shaped member.

8. The system of claim 1, wherein said hitch comprises a metallic strip bent to form a resilient hook-shaped member.

9. The system of claim 1, wherein said hitch comprises a molded plastic resilient hook-shaped member.

10. The system of claim 1, further comprising a finger-manipulable tab on each said strap adjacent said hitch for pulling said hitch downward for attachment to said band and detachment therefrom.

11. The system of claim 1, wherein said upper body garment comprises one of a shirt, blouse, sweater, vest, jacket, and shirt-jacket.

12. The system of claim 1, wherein the lower body garment comprises one of trousers, skirt, shorts and adult diaper.

13. The system of claim 1, wherein said band is a semi-rigid belt.

14. The system of claim 1, wherein said upper body garment comprises a high strength fabric having limited stretchability.

15. The system of claim 1, wherein said upper body garment comprises leather.

16. The system of claim 1, wherein at least one of said upper body and lower body garments comprise denim material.

17. The system of claim 1, wherein said folded elastic material is joined spacedly from said central fold to form a finger manipulable tab for drawing said hitch below said band for attachment thereto and detachment therefrom.

18. The system of claim 1, wherein the length of said strip of elastic material between said central fold and one of said first and second ends is less than one foot.

19. The system of claim 1, wherein said first and second ends are configured to be separately spacedly attachable to said loop fabric.

20. The system of claim 1, wherein said strip of elastic material comprises a high modulus portion and a low modulus portion.

21. A method for making a suspender strap for suspending the belt of a lower body garment from an upper body garment, comprising:

forming an elongate strip of fabric material, said strip having first and second ends and a center portion;

transversely folding said strip in said center portion thereof;

mounting a semi-rigid or rigid belt support hitch on said strip proximate said center portion, said hitch having an open side facing a first direction;

attaching said first end to a first pad of hook attachment material, said hook attachment material facing a second direction opposing said first direction;

attaching said second end to a second pad of hook attachment material, said hook attachment material facing said second direction; and forming a finger manipulable tab means proximate said center for manually stretching said strip downwardly to hitch and unhitch said belt support hitch to said belt.

22. The method of claim 21, wherein said step of forming said finger manipulable tab means comprises transversely sewing said strip to form a finger insertion loop extending in said second direction from said hitch.

23. The method of claim 21, wherein said fabric material comprises a high strength flexible material.

24. The method of claim 21, wherein said strip includes a section of elastic material.

* * * * *

UNITED STATES PATENT AND TRADEMARK OFFICE

CERTIFICATE OF CORRECTION

PATENT NO. : 5,309,572

DATED : May 10, 1994

INVENTOR(S) : Seamans, Phillip

It is certified that error appears in the above-identified patent and that said Letters Patent is hereby corrected as shown below:

in Col. 5, line 33, before "36" add --panel--therefor.

Signed and Sealed this

Twenty-fifth Day of April, 1995

*Attest:*

Bruce Lehman

BRUCE LEHMAN

*Attesting Officer*

*Commissioner of Patents and Trademarks*